US006705046B2

(12) United States Patent
Weder

(10) Patent No.: US 6,705,046 B2
(45) **Date of Patent: *Mar. 16, 2004**

(54) FLORAL SLEEVE HAVING A DECORATIVE PATTERN

(75) Inventor: Donald E. Weder, Highland, IL (US)

(73) Assignee: Southpac Trust International, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 10/303,993

(22) Filed: Nov. 22, 2002

(65) Prior Publication Data

US 2003/0131530 A1 Jul. 17, 2003

Related U.S. Application Data

(63) Continuation-in-part of application No. 10/058,250, filed on Jan. 25, 2002, now Pat. No. 6,568,129, which is a continuation of application No. 09/776,987, filed on Feb. 5, 2001, now Pat. No. 6,412,219, which is a continuation of application No. 09/459,152, filed on Dec. 10, 1999, now Pat. No. 6,199,320, which is a continuation of application No. 09/067,498, filed on Apr. 27, 1998, now Pat. No. 6,023,885.

(51) Int. Cl.[7] ..... A01G 9/02
(52) U.S. Cl. ..... 47/76; 47/65.5; 206/423
(58) Field of Search ..... 47/72, 76, 65.5; 206/423

(56) References Cited

U.S. PATENT DOCUMENTS

| | | | |
|---|---|---|---|
| 524,219 A | 8/1894 | Schmidt | |
| 732,889 A | 7/1903 | Paver | |
| 950,785 A | 3/1910 | Pene | |
| 1,044,260 A | 11/1912 | Schloss | |
| 1,063,154 A | 5/1913 | Bergen | |
| 1,446,563 A | 2/1923 | Hughes | |
| 1,520,647 A | 12/1924 | Hennigan | |
| 1,525,015 A | 2/1925 | Weeks | |
| 1,610,652 A | 12/1926 | Bouchard | |
| 1,697,751 A | 1/1929 | Blake | 229/87 |

(List continued on next page.)

FOREIGN PATENT DOCUMENTS

| | | |
|---|---|---|
| AU | 4231978 | 6/1979 |
| BE | 654427 | 1/1965 |
| CH | 560532 | 4/1975 |
| DE | 15550 | 6/1900 |
| DE | 345464 | 12/1921 |

(List continued on next page.)

OTHER PUBLICATIONS

Speed Cover Brochure, "The Simple Solution For Those Peak Volume Periods", Highland Supply Corporation, ©1989.
"Speed Sheets and Speed Rolls" Brochure, Highland Supply Corporation, ©1990.
"Color Them Happy with Highlander Products" ©1992.
"Costa Keeps the Christmas Spirit", Supermarket Floral, Sep. 15, 1992.

(List continued on next page.)

*Primary Examiner*—Robert P. Swiatek
*Assistant Examiner*—Judith A. Nelson
(74) *Attorney, Agent, or Firm*—Dunlap, Codding & Rogers

(57) ABSTRACT

A plant packaging and covering system comprising a floral sleeve having a base portion having a decorative pattern thereon. The sleeve may have an upper sleeve portion which can surround a plant disposed in a pot and which can be detached once the protective function of the sleeve is complete or which can be used to support the sleeve from a support device prior to use. The decorative pattern has a curved or non-linear upper boundary which gives the sleeve the appearance of having a curved or non-linear upper skirt extending from the base portion.

31 Claims, 5 Drawing Sheets

U.S. PATENT DOCUMENTS 1,794,212 A 2/1931 Snyder
1,811,574 A 6/1931 Barrett
1,863,216 A 6/1932 Wordingham
1,978,631 A 10/1934 Herrlinger ..... 91/68
2,048,123 A 7/1936 Howard ..... 229/87
RE21,065 E 5/1939 Copeman ..... 93/2
2,170,147 A 8/1939 Lane ..... 206/56
2,200,111 A 5/1940 Bensel ..... 229/1.5
2,278,673 A 4/1942 Savada et al. ..... 154/43
2,302,259 A 11/1942 Rothfuss ..... 41/10
2,323,287 A 7/1943 Amberg ..... 229/53
2,355,559 A 8/1944 Renner ..... 229/8
2,371,985 A 3/1945 Freiberg ..... 206/46
2,411,328 A 11/1946 MacNab ..... 33/12
2,510,120 A 6/1950 Leander ..... 117/122
2,529,060 A 11/1950 Trillich ..... 117/68.5
2,621,142 A 12/1952 Wetherell ..... 154/117
2,648,487 A 8/1953 Linda ..... 229/55
2,688,354 A 9/1954 Berger ..... 150/28
2,774,187 A 12/1956 Smithers ..... 47/41
2,822,287 A 2/1958 Avery ..... 117/14
2,846,060 A 8/1958 Yount ..... 206/58
2,850,842 A 9/1958 Eubank, Jr. ..... 47/58
2,883,262 A 4/1959 Borin ..... 21/56
2,989,828 A 6/1961 Warp ..... 53/390
3,022,605 A 2/1962 Reynolds ..... 47/58
3,080,680 A 3/1963 Reynolds ..... 47/37
3,094,810 A 6/1963 Kalpin ..... 47/37
3,121,647 A 2/1964 Harris et al. ..... 118/202
3,130,113 A 4/1964 Silman ..... 161/97
3,271,922 A 9/1966 Wallerstein et al. ..... 53/3
3,293,100 A 12/1966 Questel
3,316,675 A 5/1967 Cartwright, Jr.
3,322,325 A 5/1967 Bush ..... 229/62
3,376,666 A 4/1968 Leonard ..... 47/41
3,380,646 A 4/1968 Doyen et al. ..... 229/57
3,431,706 A 3/1969 Stuck ..... 53/390
3,508,372 A 4/1970 Wallerstein et al. ..... 53/3
3,510,054 A 5/1970 Sanni et al. ..... 229/66
3,512,700 A 5/1970 Evans et al. ..... 229/53
3,550,318 A 12/1970 Remke et al. ..... 47/37
3,552,059 A 1/1971 Moore ..... 47/41.12
3,554,434 A 1/1971 Anderson ..... 229/55
3,556,389 A 1/1971 Gregoire ..... 229/53
3,557,516 A 1/1971 Brandt ..... 53/14
3,620,366 A 11/1971 Parkinson ..... 206/59
3,681,105 A 8/1972 Milutin ..... 117/15
3,767,104 A 10/1973 Bachman et al. ..... 229/7
3,793,799 A 2/1974 Howe ..... 53/32
3,869,828 A 3/1975 Matsumoto ..... 47/34.11
3,888,443 A 6/1975 Flanigen ..... 248/152
3,962,503 A 6/1976 Crawford ..... 428/40
4,043,077 A 8/1977 Stonehocker ..... 47/66
4,054,697 A 10/1977 Reed et al. ..... 428/40
4,091,925 A 5/1978 Griffo et al. ..... 206/423
4,113,100 A 9/1978 Soja et al. ..... 206/602
4,118,890 A 10/1978 Shore ..... 47/28
4,149,339 A 4/1979 Hall et al. ..... 47/67
4,189,868 A 2/1980 Tymchuck et al. ..... 47/84
4,216,620 A 8/1980 Weder et al. ..... 47/72
4,248,347 A 2/1981 Trimbee ..... 206/423
D259,333 S 5/1981 Charbonneau ..... D9/306
4,265,049 A 5/1981 Gorewitz ..... 47/26
4,280,314 A 7/1981 Stuck ..... 53/241
4,297,811 A 11/1981 Weder ..... 47/72
4,333,267 A 6/1982 Witte ..... 47/84
4,347,686 A 9/1982 Wood ..... 47/73
4,380,564 A 4/1983 Cancio et al. ..... 428/167
4,400,910 A 8/1983 Koudstall et al. ..... 47/84
4,413,725 A 11/1983 Bruno et al. ..... 206/45.33
4,508,223 A 4/1985 Catrambone ..... 206/423
D279,279 S 6/1985 Wagner ..... D11/143
4,546,875 A 10/1985 Zweber ..... 206/0.82
4,621,733 A 11/1986 Harris ..... 206/423
4,640,079 A 2/1987 Stuck ..... 53/390
4,717,262 A 1/1988 Roen et al. ..... 383/120
4,733,521 A 3/1988 Weder et al. ..... 53/580
4,765,464 A 8/1988 Ristvedt ..... 206/0.82
4,771,573 A 9/1988 Stengel ..... 47/67
4,773,182 A 9/1988 Weder et al. ..... 47/72
4,801,014 A 1/1989 Meadows ..... 206/423
4,810,109 A 3/1989 Castel ..... 383/105
4,835,834 A 6/1989 Weder ..... 29/525
D301,991 S 7/1989 Van Sant ..... D11/149
4,900,390 A 2/1990 Colten et al. ..... 156/291
4,941,572 A 7/1990 Harris ..... 206/423
4,946,290 A 8/1990 Matyja ..... 383/10
4,980,209 A 12/1990 Hill ..... 428/34.1
4,989,396 A 2/1991 Weder et al. ..... 53/397
D315,700 S 3/1991 Stephens ..... D11/151
5,073,161 A 12/1991 Weder et al. ..... 493/154
5,074,675 A 12/1991 Osgood ..... 383/122
5,076,011 A 12/1991 Stehouwer
5,105,599 A 4/1992 Weder ..... 53/399
5,111,638 A 5/1992 Weder ..... 53/397
5,117,584 A 6/1992 Ottenwalder
5,120,382 A 6/1992 Weder ..... 156/212
5,152,100 A 10/1992 Weder et al. ..... 47/72
5,181,364 A 1/1993 Weder ..... 53/397
D335,105 S 4/1993 Ottenwalder et al. ..... D11/164
5,199,242 A 4/1993 Weder et al. ..... 53/397
5,205,108 A 4/1993 Weder et al. ..... 53/397
5,228,234 A 7/1993 de Klerk et al. ..... 47/41.01
5,235,782 A 8/1993 Landau ..... 47/72
5,239,775 A 8/1993 Landau ..... 47/72
5,249,407 A 10/1993 Stuck ..... 53/399
5,259,106 A 11/1993 Weder et al. ..... 29/469.5
5,307,606 A 5/1994 Weder ..... 53/410
5,315,785 A 5/1994 Avôt et al. ..... 47/72
5,350,240 A 9/1994 Billman et al. ..... 383/104
5,353,575 A 10/1994 Stepanek ..... 53/461
5,361,482 A 11/1994 Weder et al. ..... 29/469
5,388,695 A 2/1995 Gilbert ..... 206/423
5,428,939 A 7/1995 Weder et al. ..... 53/397
5,443,670 A 8/1995 Landau ..... 156/191
5,493,809 A 2/1996 Weder et al. ..... 47/72
D368,025 S 3/1996 Sekerak et al. ..... D9/305
5,496,251 A 3/1996 Cheng ..... 493/224
5,496,252 A 3/1996 Gilbert ..... 493/224
5,526,932 A 6/1996 Weder ..... 206/423
5,551,570 A 9/1996 Shaffer et al. ..... 206/575
5,572,849 A 11/1996 Weder et al. ..... 53/399
5,572,851 A 11/1996 Weder ..... 53/399
5,575,133 A 11/1996 Weder et al. ..... 53/397
5,617,703 A 4/1997 Weder ..... 53/413
5,624,320 A 4/1997 Martinez ..... 472/51
5,625,979 A 5/1997 Weder
5,647,168 A 7/1997 Gilbert ..... 47/72
5,647,193 A 7/1997 Weder et al. ..... 53/465
5,706,605 A 1/1998 Alcazar ..... 47/65.7
5,715,944 A 2/1998 Windisch ..... 206/423
5,735,103 A 4/1998 Weder ..... 53/399
5,758,472 A 6/1998 Weder
5,813,194 A 9/1998 Weder ..... 53/399
D404,684 S 1/1999 Shea ..... D11/164
5,924,241 A 7/1999 Hodge ..... 47/72
5,941,020 A 8/1999 Weder ..... 47/72
5,966,866 A 10/1999 Ferguson ..... 47/41.01
5,974,730 A 11/1999 Chien ..... 47/41.01
D419,436 S 1/2000 Celtorius et al. ..... D9/305
6,009,687 A 1/2000 Weder ..... 53/399

| | | | | |
|---|---|---|---|---|
| 6,047,524 | A | 4/2000 | Weder | 53/399 |
| D424,972 | S | 5/2000 | Ferguson | D11/143 |
| 6,098,336 | A | 8/2000 | Ferguson | 206/423 |
| 6,129,208 | A | 10/2000 | Ferguson | 206/423 |
| 6,129,209 | A | 10/2000 | Tchira | 206/423 |
| 6,141,906 | A | 11/2000 | Weder | 47/72 |
| 6,182,395 | B1 | 2/2001 | Weder et al. | 47/72 |
| 6,183,590 | B1 | 2/2001 | Weder | 47/72 |
| 6,568,129 | B2 * | 5/2003 | Weder | 47/76 |

FOREIGN PATENT DOCUMENTS

| | | |
|---|---|---|
| DE | 513971 | 11/1930 |
| DE | 1166692 | 3/1964 |
| DE | 1962947 | 6/1971 |
| DE | 2060812 | 11/1971 |
| DE | 2748626 | 5/1979 |
| DE | 3445799 | 6/1986 |
| DE | 3829281 | 5/1989 |
| DE | 3911847 | 10/1990 |
| EP | 0050990 | 5/1982 |
| EP | 0791543 | 8/1997 |
| FR | 1376047 | 9/1964 |
| FR | 2036163 | 12/1970 |
| FR | 2137325 | 12/1972 |
| FR | 2272914 | 12/1975 |
| FR | 2489126 | 3/1982 |
| FR | 2567068 | 7/1984 |
| FR | 2610604 | 8/1988 |
| FR | 2603159 | 3/1989 |
| FR | 2619698 | 3/1989 |
| GB | 5605 | 5/1885 |
| GB | 1204647 | 9/1970 |
| GB | 2056410 | 3/1981 |
| GB | 2074542 | 11/1981 |
| GB | 2128083 | 4/1984 |
| GB | 2203127 | 10/1988 |
| GB | 2212136 | 7/1989 |
| GB | 2252708 | 8/1992 |
| IT | 224507 | 4/1996 |
| JP | 542958 | 2/1993 |
| JP | 6127555 | 5/1994 |
| JP | 8-19334 | 1/1996 |
| NL | 8301709 | 12/1984 |
| NL | 1000658 | 1/1996 |
| WO | 9315979 | 8/1993 |
| WO | 9712819 | 4/1997 |

OTHER PUBLICATIONS

"Super Seller", Supermarket Floral, Sep. 15, 1992.

"Halloween", Link Magazine, Sep., 1992.

"Now More Than Ever", Supermarket Floral, Sep. 15, 1992.

Le Plant Sac Advertisement, published prior to Sep. 26, 1987.

"A World of Cut Flower and Pot Plant Packaging" Brochure, Klerk's Plastic Products Manufacturing, Inc., published prior to Mar. 31, 1994, 6 pages.

Chantler & Chantler brochure showing Zipper Sleeve™ and Florasheet®, published prior to Mar. 31, 1994, 2 pages.

"Stand Alone Plastic Bagmaking" brochure, AMI, Atlanta, GA, Feb. 15, 1996, 2 pages.

"Foil Jackets" brochure, Custom Medallion, Inc., Dec., 1996, 2 pages.

"Derwent Abstract" of FR 2610604A. It is noted that the abstract is an incorrect English translation of the contents of the French patent. The French patent does not enable or disclose adhesively attaching the covering to the container. 1988.

"Silver Linings" Brochure, Affinity Diversified Industries, Inc., 1986. The Silver Linings brochure shows a floral sleeve with a closed bottom. The brochure shows, in on e embodiement, a vase with flowers inside a "cut flower" sleeve with the sleeve tied with a ribbon about the neck of the vase.

"Special Occasion Printed Highlophane Bags" Brochure, Highland Supply Corporation, 1990, 2 pages.

"Creative Packaging" Brochure, John Henry Company, Sep. 1992.

"Make Highlander Your Headquarters" Brochure, Highland Supply Corporation, 1991.

* cited by examiner

FLORAL SLEEVE HAVING A DECORATIVE PATTERN

CROSS-REFERENCE TO RELATED APPLICATIONS

The present application is a continuation-in-part of U.S. Ser. No. 10/058,250, filed Jan. 25, 2002, now U.S. Pat. No. 6,568,129, which is a continuation of 09/776,987, filed Feb. 5, 2001, now U.S. Pat. No. 6,412,219, which is a continuation of U.S. Ser. No. 09/459,152, filed on Dec. 10, 1999, now U.S. Pat. No. 6,199,320; which is a continuation of U.S. Ser. No. 09/067,498 filed on Apr. 27, 1998, now U.S. Pat. No. 6,023,885.

The present application has subject matter which is related to the disclosures of U.S. Pat. No. 5,625,979, and U.S. Pat. No. 5,572,851. The specification of each of the patents listed above is hereby expressly incorporated by reference herein in its entirety.

FIELD OF THE INVENTION

This invention generally relates to sleeves, and more particularly, to sleeves used to wrap floral groupings or flower pots containing floral groupings and/or mediums containing floral groupings, and methods of using same.

DESCRIPTION OF THE PREFERRED EMBODIMENTS

Figure 1:
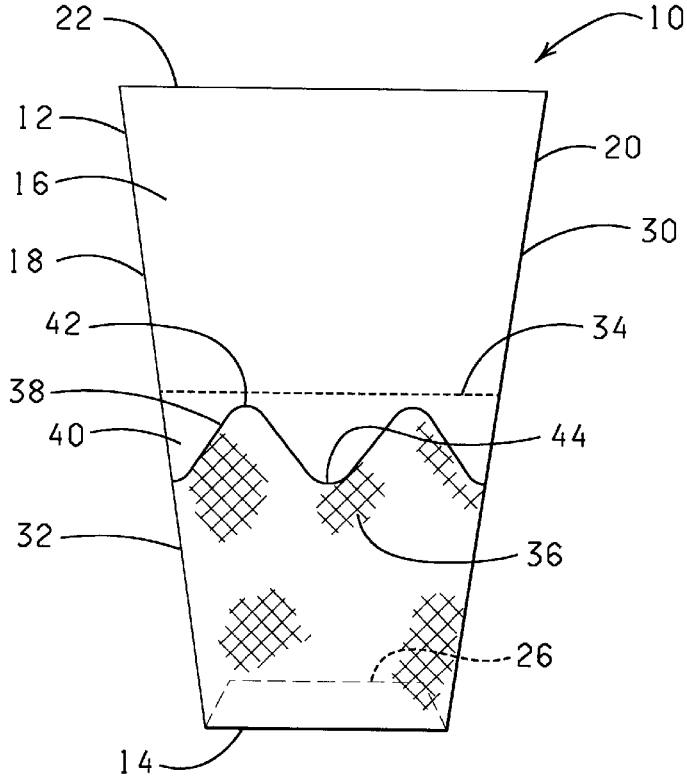
FIG. 1 is a an elevational view of a sleeve having a base portion with a decorative pattern having a curved upper boundary and having an upper detachable portion and constructed in accordance with the present invention.

The present invention contemplates in a preferred version a preformed tubular sleeve for covering a pot having an upper end, a lower end, and an outer peripheral surface. The preformed tubular sleeve comprises a base portion having an upper end, a lower end, and an inner retaining space. The preformed tubular sleeve may further comprise a detachable upper sleeve portion (also referred to herein as an upper portion) generally sized to surround and enclose a floral grouping. The upper sleeve portion when present may be detachable via perforations, tear strips, weakened areas, or zippers. The upper sleeve portion may have one or more apertures or an extended upper portion for serving as a handle or support device.

The preformed tubular sleeve may form part of a plant package when used in conjunction with a pot assembly disposed within the inner retaining space of the base portion of the preformed tubular sleeve, the pot assembly having a floral grouping disposed therein, and wherein the pot of the pot assembly is substantially surrounded and encompassed by the base portion and the floral grouping is substantially surrounded and encompassed and enclosed by the upper sleeve portion when it forms a part of the preformed tubular sleeve.

Also, the base portion may comprise a bonding material disposed on an inner portion thereof for bondingly connecting to a pot disposed therein; or the bonding material may be disposed on an outer portion thereof.

The base portion of the preformed tubular sleeve may be constructed from a first material and the upper portion (where present) constructed from a second material different from the first material. The preformed tubular sleeve may comprise a portion of a plant package which additionally comprises a pot assembly disposed within the preformed tubular sleeve, the pot assembly having a floral grouping disposed therein, and wherein the pot of the pot assembly is substantially surrounded and encompassed by the base portion.

These embodiments and others of the present invention are now described in more detail below. It will be appreciated that the examples provided herein are not intended to limit the scope and extent of the claimed invention but are only intended to exemplify various embodiments of the invention contemplated herein.

The Embodiments and Methods of Use of FIGS. 1–12D

Shown in FIG. 1 and designated therein by the general reference numeral 10 is a flexible preformed sleeve (also, hereinafter referred to as the sleeve 10) of unitary construction. The sleeve 10 preferably initially comprises a flexible flat collapsed piece of material which is openable in the form of a tube or sleeve. In an alternative embodiment, the sleeve may be formed in an opened frusto-conical configuration. The sleeve 10 is preferably tapered outwardly from the lower end toward a larger diameter at its upper end. In its flattened state the sleeve 10 has an overall trapezoidal or modified trapezoidal shape, and when opened is substantially frusto-conical to coniform. It will be appreciated, however, that the sleeve 10 may comprise variations on the aforementioned shapes or may comprise significantly altered shapes such as square or rectangular, wherein the sleeve 10 when opened has a cylindrical form, as long as the sleeve 10 functions in accordance with the present invention in the manner described herein.

Figure 4:
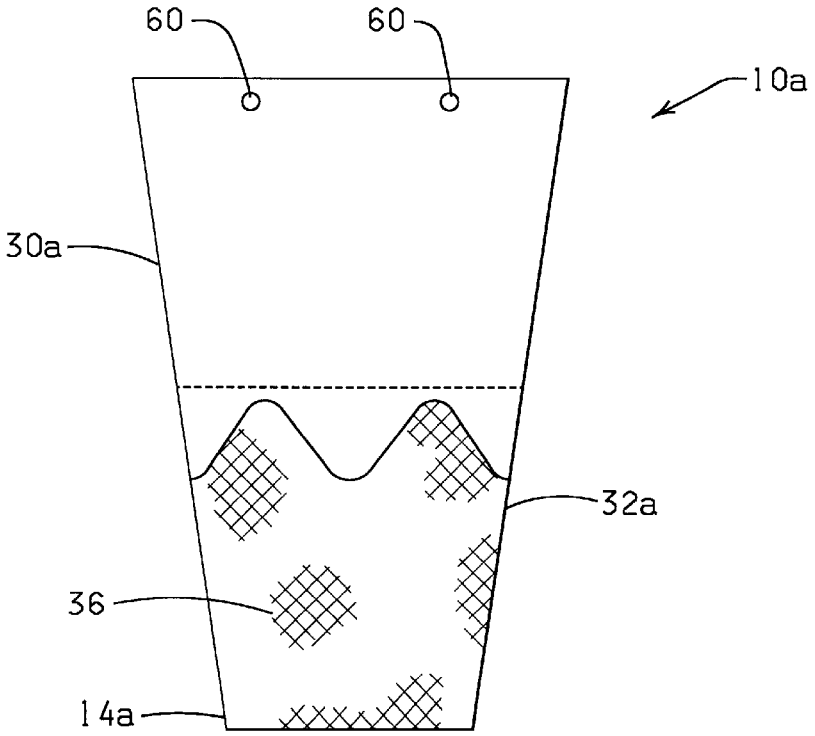
FIG. 4 is an elevational view of another sleeve constructed in accordance with the present invention.

The sleeve 10 has an upper end 12, a lower end 14, an outer peripheral surface 16 and in its flattened state has a first side 18 and a second side 20. The sleeve 10 has an opening 22 at the upper end 12 and may be open at the lower end 14 (not shown), or closed with a bottom at the lower end 14. The sleeve 10 also has an inner peripheral surface 24 which, when the sleeve 10 is opened, defines and encompasses an inner retaining space as indicated in FIG. 2. When the lower end 14 of the sleeve 10 is closed, a portion of the lower end 14 may be inwardly or outwardly folded to form one or more gussets 26 constructed in a manner well known to one of ordinary skill in the art as shown in FIG. 1 for permitting a bottom of an object such as a potted plant to be disposed into the inner retaining space of the lower end 14 of the sleeve 10. Further the lower end 14 may be constructed in the manner shown in copending U.S. Pat. No. 6,182,395, the specification of which is hereby incorporated herein in its entirety. FIG. 4 shows a sleeve 10*a* formed without a gusset in a lower end 14*a*.

The sleeve 10 is generally frusto-conically shaped, but the sleeve 10 may be, by way of example but not by way of limitation, cylindrical, frusto-conical, a combination of both frusto-conical and cylindrical, or any other shape, as long as the sleeve 10 functions as described herein as noted above. Further, the sleeve 10 may comprise any shape, whether geometric, non-geometric, asymmetrical and/or fanciful as long as it functions in accordance with the present invention. The sleeve 10 may also be equipped with a drainage element (e.g., one or more holes) in the base portion or bottom thereof or ventilation holes (not shown) in the base or upper portion, or can be made from permeable or impermeable materials.

The material from which the sleeve 10 is constructed preferably has a thickness in a range from about 0.1 mil to about 30 mils. Often, the thickness of the sleeve 10 is in a range from about 0.5 mil to about 10 mils. Preferably, the sleeve 10 has a thickness in a range from about 1.0 mil to about 5 mils. More preferably, the sleeve 10 is constructed from a material which is flexible, semi-rigid, rigid, or any combination thereof. The sleeve 10 may be constructed of a single layer of material or a plurality of layers of the same or different types of materials. Any thickness of the material may be utilized as long as the material functions in accordance with the present invention as described herein. The layers of material comprising the sleeve 10 may be connected together or laminated or may be separate layers. Such materials used to construct the sleeve 10 are described in U.S. Pat. No. 5,111,637 entitled "Method For Wrapping A Floral Grouping" issued to Weder et al., on May 12, 1992, which is hereby incorporated herein by reference. Any thickness of material may be utilized in accordance with the present invention as long as the sleeve 10 may be formed as described herein, and as long as the sleeve 10 in its formed condition may contain at least a portion of a pot or potted plant or a floral grouping, as described herein. Additionally, an insulating material such as bubble film, preferable as one of two or more layers, can be utilized in order to provide additional protection for the item, such as the floral grouping, contained therein.

In one embodiment, the sleeve 10 may be constructed from a sheet comprising two polypropylene films. The polypropylene films comprising the sleeve 10 may be connected together or laminated or may be separate layers. In an alternative embodiment, the sleeve 10 may be constructed from only one of the polypropylene films.

The sleeve 10 is constructed from any suitable material that is capable of being formed into a sleeve and wrapped about a pot and a floral grouping disposed therein. Preferably, the material comprises paper (untreated or treated in any manner), metal foil, polymeric film, non-polymeric film, fabric (woven or nonwoven or synthetic or natural), cardboard, fiber, cloth, burlap, or laminations or combinations thereof.

The term "polymeric film" means a man-made polymer such as a polypropylene or a naturally occurring polymeric such as cellophane. A polymer film is relatively strong and not as subject to tearing (substantially non-tearable), as might be the case with paper or foil.

The material comprising the sleeve 10 may vary in color and as described herein consists of designs or decorative patterns which are printed, etched, and/or embossed thereon using inks or other printing materials. An example of an ink which may be applied to the surface of the material is described in U.S. Pat. No. 5,147,706 entitled "Water Based Ink On Foil And/Or Synthetic Organic Polymer" issued to Kingman on Sep. 15, 1992 and which is hereby incorporated herein by reference.

In addition, the material may have various colorings, coatings, flocking and/or metallic finishes, or other decorative surface ornamentation applied separately or simultaneously or may be characterized totally or partially by pearlescent, translucent, transparent, iridescent, neon, or the like, qualities. The material may further comprise, or have applied thereto, one or more scents. Each of the above-named characteristics may occur alone or in combination and may be applied to the upper and/or lower surface of the material comprising the sleeve 10. Moreover, portions of the material used in constructing the sleeve 10 may vary in the combination of such characteristics. The material utilized for the sleeve 10 itself may be opaque, translucent, transparent, or partially clear or tinted transparent.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. The floral grouping comprises a bloom or foliage portion (also referred to herein as an upper portion) and a stem portion (also referred to herein as a lower portion). Further, the floral grouping may comprise a growing potted plant having a root portion (not shown) as well. However, it will be appreciated that the floral grouping may consist of only a single bloom or only foliage, or a botanical item (not shown), or a propagule (not shown). The term "floral grouping" may be used interchangeably herein with both the terms "floral arrangement" and "potted plant". The term "floral grouping" may also be used interchangeably herein with the terms "botanical item" and/or "propagule".

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

In accordance with the present invention, a bonding material may optionally be disposed on a portion of the sleeve 10 to attach the sleeve 10 to the pot having the floral grouping therein when such a pot is disposed within the sleeve or to assist in closing or sealing the upper portion of the sleeve 10 or in adhering the sleeve 10 to the pot after the pot has been disposed therein, as will be discussed in further detail below.

It will be understood that the bonding material may be disposed as a strip or block on a surface of the sleeve 10. Further, the bonding material may be disposed as spots of bonding material, or in any other geometric, non-geometric, asymmetric, or fanciful form, and in any pattern including covering either the entire inner peripheral surface 24 and/or outer peripheral surface 16 of the sleeve 10 and/or the pot or pot cover. The bonding material may be covered by a cover or release strip which can be removed prior to the use of the sleeve, pot or pot cover. The bonding material can be applied by means known to those of ordinary skill in their art. One method for disposing a bonding material, in this case an adhesive, is described in U.S. Pat. No. 5,111,637 entitled "Method For Wrapping A Floral Grouping" issued to Weder et al., on May 12, 1992, which has been incorporated by reference above.

The term "bonding material" when used herein means an adhesive, frequently a pressure sensitive adhesive, or a cohesive. When the bonding material is a cohesive, a similar cohesive material must be placed on the adjacent surface for bondingly contacting and bondingly engaging with the cohesive material. The term "bonding material" also includes materials which are heat sealable and, in this instance, the adjacent portions of the material must be brought into contact and then heat must be applied to effect the seal. The term "bonding material" also includes materials which are sonic sealable and vibratory sealable. The term "bonding material" when used herein also means a heat sealing lacquer or hot melt material which may be applied to the material and, in this instance, heat, sound waves, or vibrations, also must be applied to effect the sealing.

Alternatively, a cold seal adhesive may be utilized as the bonding material. The cold seal adhesive adheres only to a similar substrate, acting similarly as a cohesive, and binds only to itself. The cold seal adhesive, since it bonds only to a similar substrate, does not cause a residue to build up on equipment, thereby both permitting much more rapid disposition and use of such equipment to form articles and reducing labor costs. Further, since no heat is required to effect the seal, the dwell time, that is, the time for the sheet of material to form and retain the shape of an article, such as a flower pot cover or flower pot, is reduced. A cold seal adhesive binds quickly and easily with minimal pressure, and such a seal is not readily releasable. This characteristic is different from, for example, a pressure sensitive adhesive.

Figure 2:
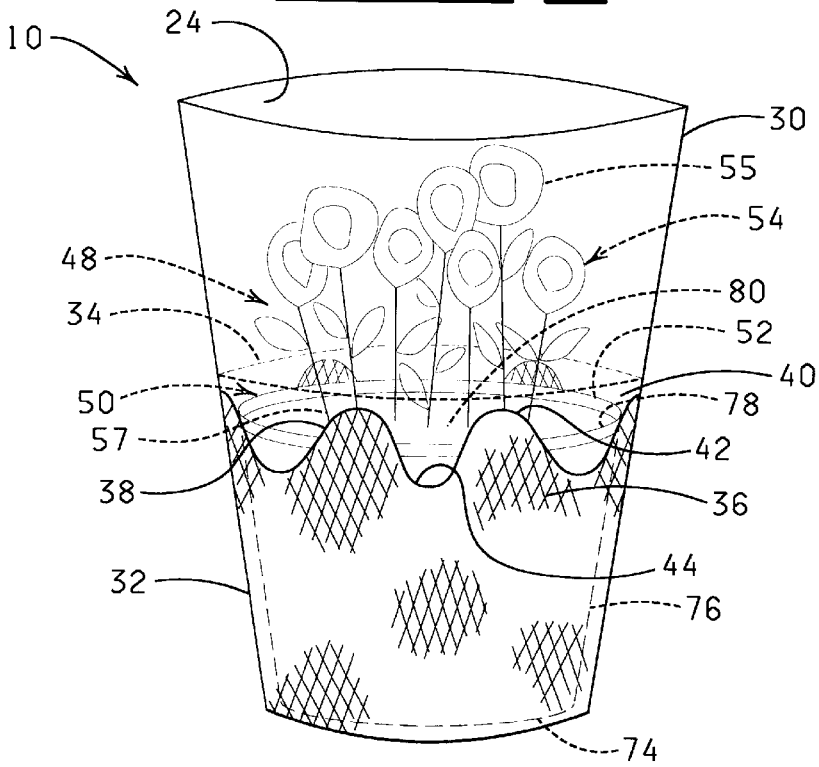
FIG. 2 is a perspective view of a potted plant disposed within the sleeve of FIG. 1.
Figure 3:
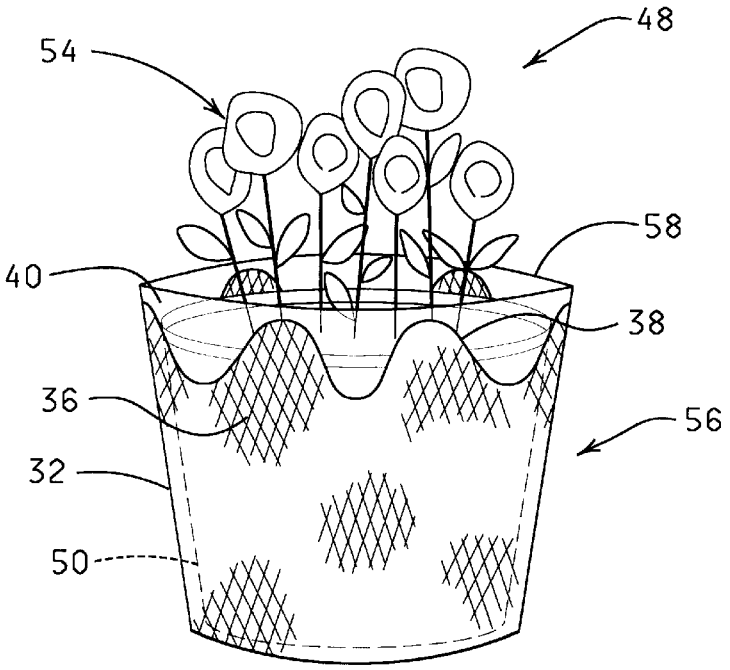
FIG. 3 is a perspective view of the sleeve and potted plant of FIG. 2 after the upper detachable portion of the sleeve has been removed from the base portion of the sleeve.

As shown in FIG. 1 and FIG. 2, the sleeve 10 in one embodiment is demarcated into an upper portion 30 and a lower or base portion 32. The base portion 32 of the sleeve 10 is generally sized to contain a potted plant. Preferably, the base portion 32 is tapered to fit the shape of a standard pot. The upper portion 30 of the sleeve 10 is sized to substantially surround and enclose a floral grouping contained within the pot disposed within the base portion 32 of the sleeve 10. The sleeve 10 is demarcated into the upper portion 30 and the base portion 32 by a detaching element 34 for enabling the detachment of the upper portion 30 of the sleeve 10 from the base portion 32 of the sleeve 10. In the present version, the detaching element 34 is a plurality of horizontally oriented perforations comprising a horizontal line which extends circumferentially across the outer peripheral surface 16 of the sleeve 10 from the first side 18 to the second side 20. The term "detaching element," as used generally herein, means any element, or combination of elements, or features, such as, but not by way of limitation, perforations, tear strips, zippers, and any other devices or elements of this nature known in the art, or any combination thereof, which enable the tearing away or detachment of one object from another. Therefore, while perforations are shown and described in detail herein, it will be understood that tear strips, zippers, or any other "detaching elements" known in the art, or any combination thereof, could be substituted therefore and/or used therewith.

In a preferred embodiment, as shown in FIG. 1, the sleeve 10 has a decorative pattern 36 disposed upon or inherent to the base portion 32. The decorative pattern 36 has a curved upper boundary 38 preferably positioned entirely below the detaching element 34, which in the preferred embodiment is a horizontal line of perforations. The curved upper boundary 38 may partially extend above the detaching element 34, but is substantially below the detaching element 34, for example at least 50% of the length of the curved upper boundary 38 is below the detaching element 34. The decorative pattern 36 may be a solid color, or multicolored print, or may be comprised of a plurality of individual patterns such as a floral print composed of a pattern of leaves and blossoms. Between the detaching element 34 and the curved upper boundary 38 is a clear zone 40 comprising an unprinted zone which is clear and transparent, and has no printing thereon. The curved upper boundary 38 may comprise a distinct demarcation between the clear zone 40 and the decorative pattern 36, or may comprise less definite boundary (for example, comprising edges of a floral print, but which when viewed from a distance still provides the sleeve 10 with an appearance of having the curved upper boundary 38. The decorative pattern 36 may cover all of, or just a portion of, the base portion 32 below the clear zone 40. In a preferred embodiment the curved upper boundary 38 has a plurality of peaks 42 and troughs 44. The peaks 42 are preferably within about 0.0 mm to about 25 mm of the detaching element 34 and the troughs 44 are generally about 10 mm to about 60 mm below the detaching element 34. These distances are not absolute and the peaks 42 and troughs 44 of the curved upper boundary 38 may be lesser or greater than the distances listed above.

The decorative pattern 36 may be disposed upon or inherent to the entire surface of the base portion 32 below the clear zone 40, or it may be disposed upon only a portion of the surface of the base portion 32.

Shown in FIG. 2 is a potted plant 48 disposed within the sleeve 10. The potted plant 48 comprises a pot 50 which has an upper rim 52 and a plant or floral grouping 54 having an upper portion 55 and a lower portion 57, and disposed within the pot 50. When the upper portion 30 of the sleeve 10 is removed (FIG. 3), the lower portion 32 is left remaining as a decorative covering 56 about the potted plant 48. Although the decorative covering 48 now has a substantially straight upper edge 58, the decorative covering has the appearance, or illusion, of having a curved upper edge, due to the curved upper boundary 38 of the decorative pattern 36 on the base portion 32 and since the clear zone 40 is clear and transparent, and therefore inconspicuous.

Figure 5:
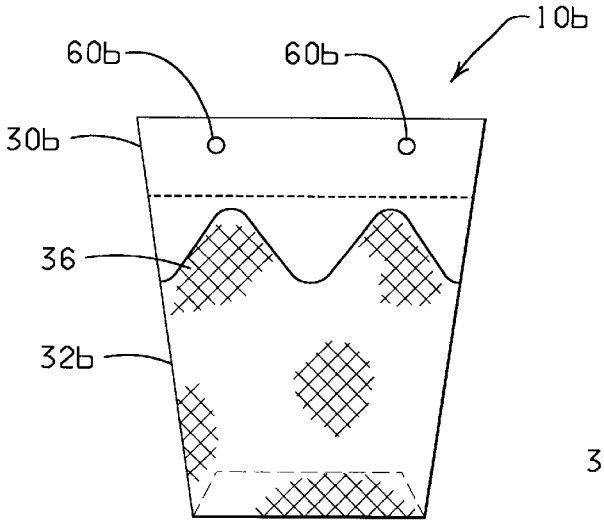
FIG. 5 is an elevational view of another sleeve constructed in accordance with the present invention.
Figure 6:
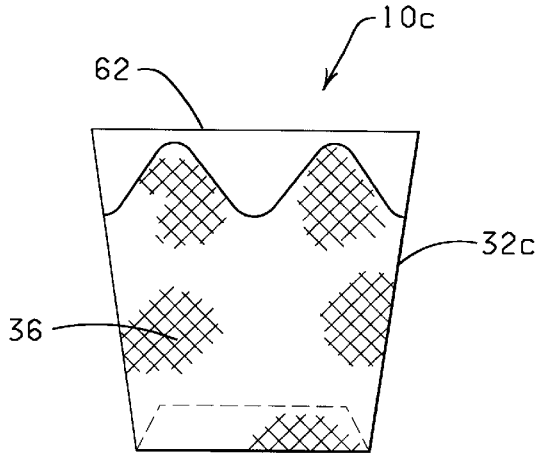
FIG. 6 is an elevational view of another sleeve constructed in accordance with the present invention.

Three other embodiments of the invention are shown in FIGS. 4–6. FIG. 4 shows a sleeve 10*a* which is exactly the same as sleeve 10 except sleeve 10*a* has apertures 60 for enabling the plurality of sleeves 10*a* to be placed on a support device such as a wicket or hook (not shown). Sleeve 10*a* has a base portion 32*a* and an upper portion 30*a* which is sized to substantially enclose a floral grouping. As shown in FIG. 4, sleeve 10*a* does not have a gusset, but one of ordinary skill in the art will understand that the sleeve 10*a* could be manufactured with a gusset in the lower end thereof. FIG. 5 shows a sleeve 10*b* having an upper portion 30*b* which has apertures 60*b* for use in supporting the sleeve 10*b* from a support device. Unlike the upper portion 30*a* of sleeve 10*a*, the upper portion 30*b* of sleeve 10*b* is not sized to enclose a floral grouping and is intended to be removed from a base portion 32*b* before the sleeve 10*b* is placed about a pot as a decorative covering. Further, as shown in FIG. 6, sleeve 10*c* is the same as sleeves 10–10*b* except it is constructed without a detachable upper portion such that sleeve 10*c* has a base portion 32*c* having a substantially straight upper edge 62. In effect, when sleeve 10*c* is placed as a decorative covering about a pot, it has the same overall appearance as the decorative covering 56 in FIG. 3, after the upper portion 30 has been removed from sleeve 10.

Figure 7:
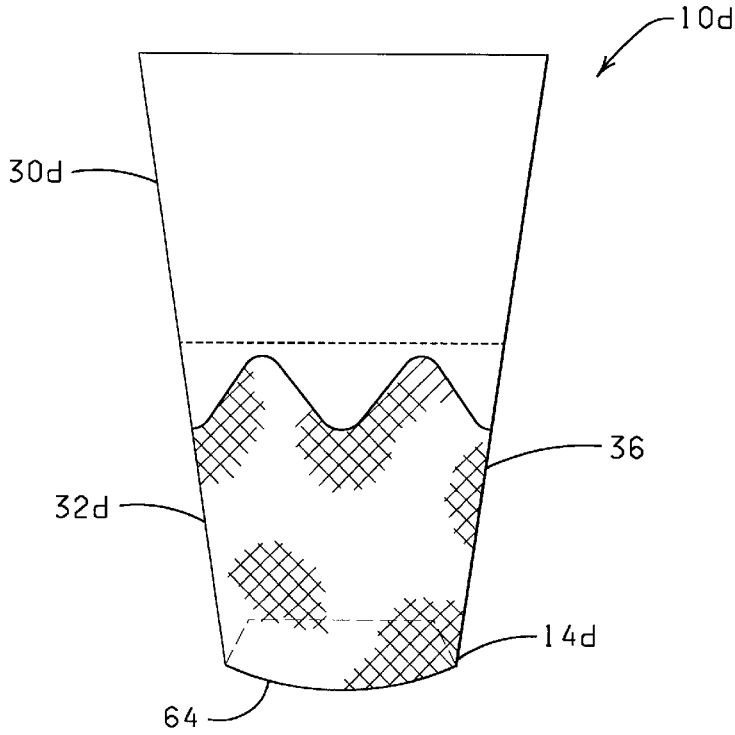
FIG. 7 is an elevational view of yet another sleeve constructed in accordance with the present invention.

Other embodiments of the present invention are shown in FIGS. 7–11. Shown in FIG. 7 is sleeve 10*d* which is the same as sleeve 10 except sleeve 10*d* has a lower end 14*d* which has a curved end 64, rather than a straight end. Sleeve 10*d* is shown as having a base portion 32*d* and a detachable upper portion 30*d*, but it will be appreciated that sleeve 10*d* may be constructed having an upper portion similar to sleeves 10*a* or 10*b*, or may be constructed without an upper portion similar to sleeve 10*c*.

Figure 8:
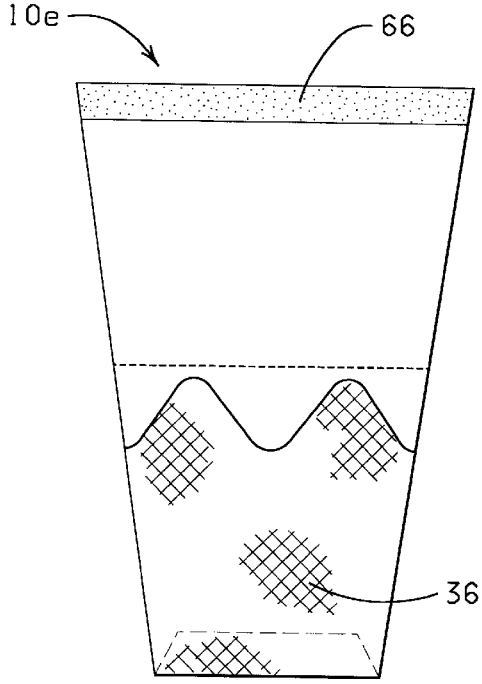
FIG. 8 is an elevational view of yet another sleeve constructed in accordance with the present invention.

FIG. 8 shows a sleeve 10*e* which may be constructed exactly the same as any of sleeves 10–10*b* or 10*d* having the base portion 32*d* and the upper portion 30*d* except a closure bonding material 66 is disposed on or near an upper end portion of an upper portion 30*e* of the sleeve 10*e* for enabling closure of the upper portion 30*e* after a potted plant has been disposed within the sleeve 10*e*.

Figure 9:
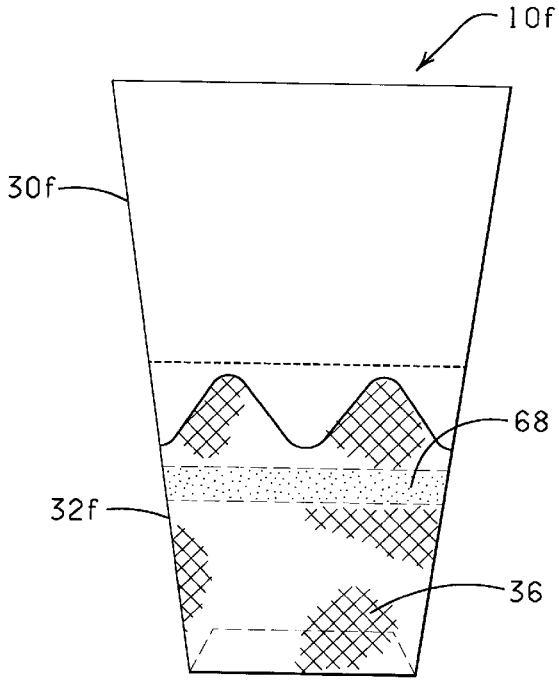
FIG. 9 is an elevational view of yet another sleeve constructed in accordance with the present invention.

FIG. 9 shows a sleeve 10*f* having an upper portion 30*f* a bonding material 68 disposed upon a portion of the inner surface of a base portion 32*f* of the sleeve 10*f*, otherwise the sleeve 10*f* may be constructed in a manner similar to any of sleeves 10–10*e*. The bonding material 68 may be used to attach the base portion 32*f* to a pot disposed therein, or it may be used in forming a crimped portion (not shown) in the base portion 32*f* after a pot is disposed therein.

Figure 10:
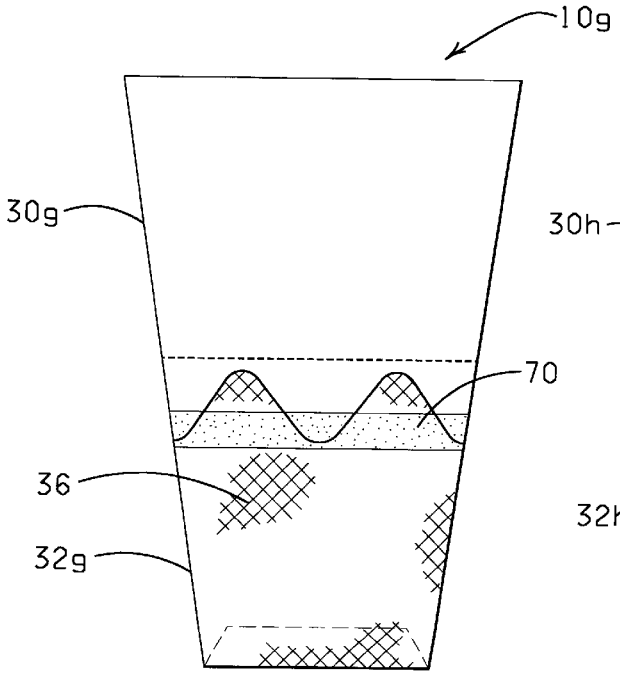
FIG. 10 is an elevational view of yet another sleeve constructed in accordance with the present invention.

FIG. 10 shows a sleeve 10*g* which may be constructed the same as any of sleeves 10–10*f* having a base portion 32*g* and an upper portion 30*g*, except sleeve 10*g* has a bonding material 70 on an outer surface of the base portion 32*g* thereof. The bonding material 70 may be used to form a crimped portion (not shown) in the lower portion 32*g*.

Figure 11:
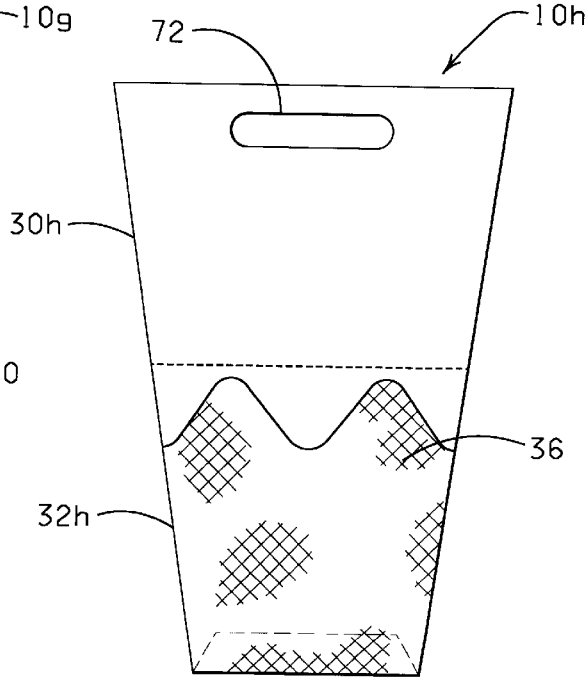
FIG. 11 is an elevational view of yet another sleeve constructed in accordance with the present invention.

FIG. 11 shows a sleeve 10*h* having a base portion 32*h* and an upper portion 30*h* and having an aperture 72 in an upper end of an upper portion 30*h* for use as a handle, for enabling the sleeve 10*h* having a pot disposed therein to be carried. Sleeve 10*h* may be constructed the same as any of the sleeves described elsewhere herein which have an upper portion sized to enclose a potted plant.

The upper portion 30 of the sleeve 10 (FIGS. 1 and 2) may also have an additional vertical detaching element comprising a plurality of vertical perforations (not shown) for facilitating removal of the upper portion 30 and which are disposed more or less vertically therein extending between the detaching element 34 of the sleeve 10 and the upper end 12. The upper portion 30 of the sleeve 10 is separable from the base portion 32 of the sleeve 10 by tearing the upper portion 30 along both the vertical perforations (when present) and the detaching element 34, thereby separating the upper portion 30 from the base portion 32 of the sleeve 10. The base portion 32 of the sleeve 10 remains disposed about the pot forming a decorative cover which substantially surrounds and encompasses the pot of the potted plant.

It will be understood by a person of ordinary skill in the art that equipment and devices for forming floral sleeves are commercially available, and are well known to a person of ordinary skill in the art. Therefore, further discussion of the construction of the covers described herein is not deemed necessary.

As noted above, any of sleeves 10–10*h* may have an open or closed lower end. When the lower end is closed, the lower end may have one or more gussets, such as gusset 26, formed therein for allowing expansion of the lower end when an object with a broad lower end such as a pot is disposed therein. In another version of sleeve 10*e*, the sleeve may comprise a flap positioned at the upper end of the upper portion 30*e* which can be folded over and sealed with a flap bonding strip to an adjacent portion of the outer peripheral surface of the sleeve 10*e* near the upper end thereof. Other versions of the sleeve (not shown) may comprise ventilation holes or drainage (e.g., holes) in the base portion 32 for allowing movement of gases or moisture to and away from the inner space of the sleeve.

As noted above, it will generally be desired to use the sleeves described herein as coverings for a potted plant. As shown in FIG. 2, the potted plant comprises the pot 50 having the upper rim 52, a lower end 74, an outer peripheral surface 76, and an inner peripheral surface 78 which encompasses an inner space 80 for retaining the floral grouping or plant 54. The lower end of the pot is closed but may have holes for permitting water drainage. The term "pot" as used herein refers to any type of container used for holding a floral grouping or plant. Examples of pots, used in accordance with the present invention include, but not by way of limitation, clay pots, foam pots, wooden pots, plastic pots, pots made from natural and/or synthetic fibers, or any combination thereof. The pot is adapted to receive a floral grouping in the retaining space. The floral grouping may be disposed within the pot along with a suitable growing medium described in further detail below, or other retaining medium, such as a floral foam. It will also be understood that the floral grouping, and any appropriate growing medium or other retaining medium, may be disposed in the sleeve without a pot.

In an alternative version of the invention, a bonding material may be disposed on the outer peripheral surface of the pot while the sleeve 10–10*h* is free of a bonding material. In this case, when the pot is disposed into the open sleeve, the bonding material on the outer peripheral surface of the pot engages a portion of the inner peripheral surface of the sleeve causing the sleeve to be bondingly connected to a portion of the outer surface of the pot.

In yet another version of the method of the present invention, a bonding material may be disposed on the both outer surface of the pot and the inner peripheral surface of any of the sleeves mentioned herein. In such a case, preferably the bonding material both of the pot and the sleeve is a cohesive which allows bonding to a surface covered with the cohesive but not to dissimilar surfaces. Any of the sleeves described herein may be secured about a pot and floral grouping by a bonding element comprising a rubber or elastic band, tie, string, ribbon, collar, wire, tape, staple, plastic band, stribbon, or other such tying devices to form a plant package.

Figure 12A:
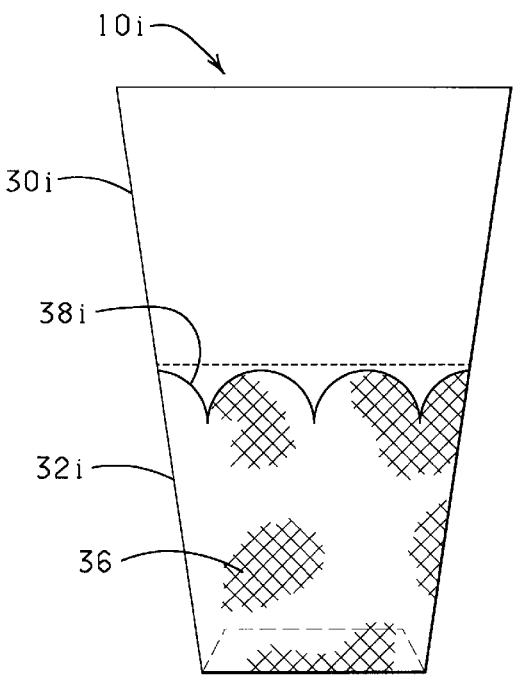
FIG. 12A is an elevational view of a sleeve constructed in accordance with the present invention and having a decorative pattern having an upper boundary having a crenate or scalloped pattern.
Figure 12B:
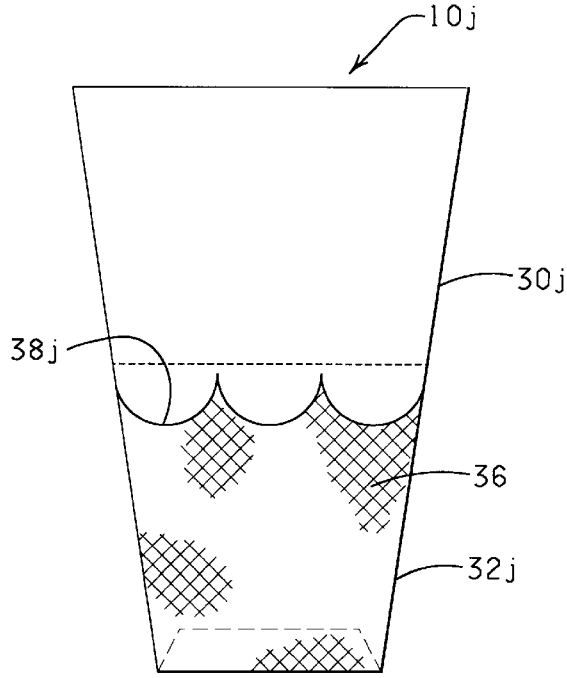
FIG. 12B is an elevational view of a sleeve constructed in accordance with the present invention and having a decorative pattern having an upper boundary having an inverted crenate or inverted scalloped pattern.
Figure 12C:
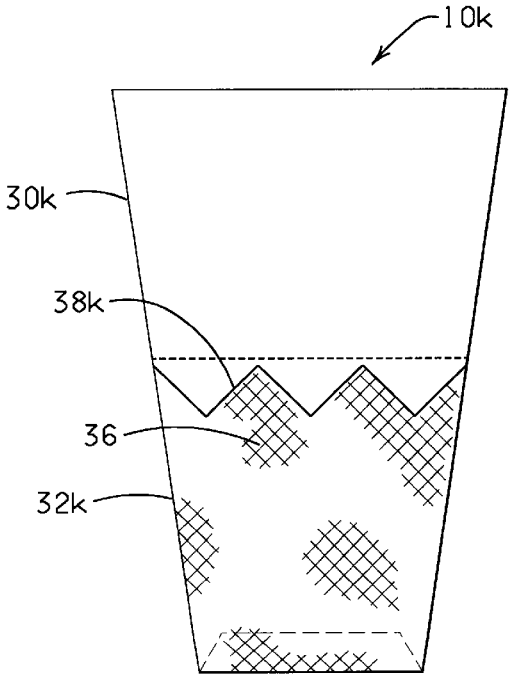
FIG. 12C is an elevational view of a sleeve constructed in accordance with the present invention and having a decorative pattern having an upper boundary having a crenulate, toothed, or zig-zag pattern.
Figure 12D:
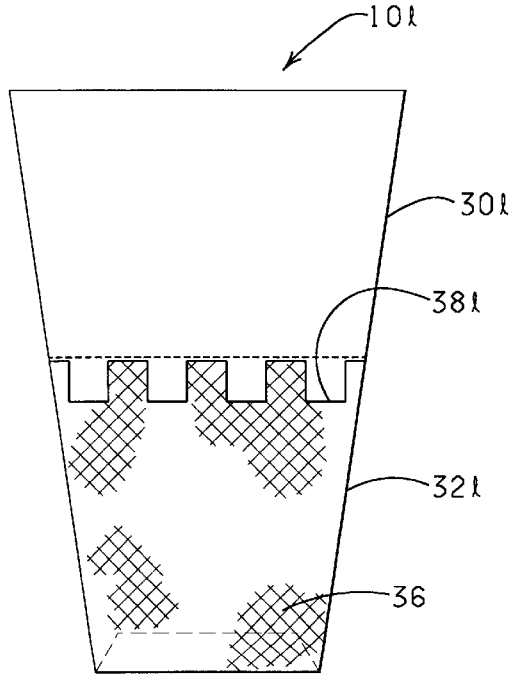
FIG. 12D is an elevational view of a sleeve constructed in accordance with the present invention and having a decorative pattern having an upper boundary having a crenelated or rectangular-shaped pattern.

As shown in FIGS. 1–11, the decorative pattern 36 preferably comprises a curved upper boundary. However, the configuration of the upper boundary of the decorative pattern is not necessarily meant to be limited to a "curved" design and may be constructed in any number of other "non-linear" patterns, several being shown in FIGS. 12A–12D. For example, FIG. 12A shows a sleeve 10*i* having an upper portion 30*i*, a base portion 32*i*, and an upper boundary 38*i* having a crenate or scalloped pattern. FIG. 12B shows sleeve 10*j* having an upper portion 30*j*, a base portion 32*j*, and an upper boundary 38*j* having a crenate or scalloped pattern which is inverted. FIG. 12C shows a sleeve 10*k* having an upper portion 30*k*, a base portion 32*k*, and an upper boundary 38*k* having a crenulate toothed or zig-zag pattern. FIG. 12D shows a sleeve 101 having an upper portion 301, a base portion 321, and an upper boundary 38*l* having a crenelated or rectangular-shaped pattern. Accordingly, when each of the upper portions 30*i*–30*l* is detached from the base portion 32*i*–32*l*, respectively, each base portion 32*i*–32*l* is left having the appearance of a non-linear upper end due to the non-linear boundary 38*i*–38*l*, respectively. One of ordinary skill in the art will understand these are but a few of the patterns that the perforations may form and one of ordinary skill could contemplate many other suitable patterns.

The sleeves described herein may be formed by intermittently advancing two separate webs, one or two webs preformed in the form of a tube, or a single web folded double and sealing the longitudinal sides and bottom of the two facing panels then cutting the sleeve thus formed from the webs or web. Machines which can form sleeves from such single webs or pairs of webs are well within the knowledge of one of ordinary skill in the art.

It should also be noted that for all versions of sleeves described above which have a bonding material thereon, it may be desirable to have a release material or cover strip covering the adhesive or cohesive bonding material disposed on any portion of the sleeve for preventing the bonding material from bonding to another surface until the desired time. Further in each of the cases described herein wherein a sleeve is applied to a pot or a covered pot, the sleeve may be applied thereto either by depositing the pot or covered pot downwardly into the open retaining space of the sleeve, or the sleeve may be brought upwardly about the pot or covered pot from below the pot or a covered pot.

It should be further noted that various features of the versions of the present invention such as closure bonding areas, support apertures, handles or handle apertures, additional perforations, drainage holes, ventilation holes, combinations of material may be used alone or in combination as elements of any of the embodiments described above herein.

Changes may be made in the construction and the operation of the various components, elements and assemblies described herein or in the steps or the sequence of steps of the methods described herein without departing from the spirit and scope of the invention as defined in the following claims.

What is claimed is:

1. A tubular sleeve, comprising:

a base portion having a tapered shape and a lower end and sized to contain a pot;

an upper portion detachable from the base portion via a detaching element; and a decorative pattern or coloring disposed on or inherent to at least a portion of the base portion, with the decorative pattern having a non-linear upper boundary positioned substantially below the detaching element and wherein the base portion has a clear zone between the detaching element and that portion of the non-linear upper boundary of the decorative pattern or coloring positioned below the detaching element.

2. The tubular sleeve of claim 1 wherein the upper portion is sized to substantially surround and enclose a floral grouping disposed within the pot.

3. The tubular sleeve of claim 2 wherein the upper portion is adapted to suspend the tubular sleeve from a support element.

4. The tubular sleeve of claim 1 wherein the upper portion is adapted to suspend the tubular sleeve from a support element.

5. The tubular sleeve of claim 1 wherein the non-linear upper boundary of the decorative pattern or coloring comprises a plurality of peaks and troughs wherein the peaks are generally within 0 mm to about 25 mm of the detaching element and the troughs are generally about 10 mm to about 60 mm below the detaching element.

6. The tubular sleeve of claim 1 wherein the lower end of the base portion has a gusset therein.

7. The tubular sleeve of claim 1 wherein the tubular sleeve initially has a flattened state.

8. A tubular sleeve for decoratively covering a pot having an upper rim, the tubular sleeve comprising:

a base portion having a tapered shape, an upper edge, a lower end, and a decorative pattern or coloring disposed on or inherent to at least a portion of the base portion, the decorative pattern or coloring having a non-linear upper boundary positioned below the upper edge of the base portion, and the base portion having a clear zone between the upper edge of the base portion and the non-linear upper boundary of the decorative pattern or coloring.

9. The tubular sleeve of claim 8 wherein the non-linear upper boundary of the decorative pattern or coloring comprises a plurality of peaks and troughs wherein the peaks are generally within 0 mm to about 25 mm of the upper edge of the base portion and the troughs are generally about 10 mm to about 60 mm below the upper edge of the base portion.

10. The tubular sleeve of claim 8 wherein the lower end of the base portion has a gusset therein.

11. The tubular sleeve of claim 8 wherein the tubular sleeve initially has a flattened state.

12. A tubular sleeve, comprising:

a base portion sized to contain a pot and having a gusset in a lower end thereof;

an upper portion detachable from the base portion via a detaching element; and a decorative pattern or coloring disposed on or inherent to at least a portion of the base portion, with the decorative pattern having a non-linear upper boundary positioned substantially below the detaching element, and wherein the base portion has a clear zone between the detaching element and that portion of the non-linear upper boundary of the decorative pattern or coloring positioned below the detaching element.

13. The tubular sleeve of claim 12 wherein the upper portion is sized to substantially surround and enclose a floral grouping disposed within the pot.

14. The tubular sleeve of claim 13 wherein the upper portion is adapted to suspend the tubular sleeve from a support element.

15. The tubular sleeve of claim 12 wherein the upper portion is adapted to suspend the tubular sleeve from a support element.

16. The tubular sleeve of claim 12 wherein the non-linear upper boundary of the decorative pattern or coloring comprises a plurality of peaks and troughs wherein the peaks are generally within 0 mm to about 25 mm of the detaching element and the troughs are generally about 10 mm to about 60 mm below the detaching element.

17. The tubular sleeve of claim 12 wherein the tubular sleeve initially has a flattened state.

18. A tubular sleeve for decoratively covering a pot, comprising:

a base portion sized to contain a pot and having an upper edge and having a gusset in a lower end thereof, and a decorative pattern or coloring disposed on or inherent to at least a portion of the base portion, the decorative pattern or coloring having a non-linear upper boundary positioned below the upper edge of the base portion, and the base portion having a clear zone between the upper edge of the base portion and the non-linear upper boundary of the decorative pattern or coloring.

19. The tubular sleeve of claim 18 wherein the non-linear upper boundary of the decorative pattern or coloring comprises a plurality of peaks and troughs wherein the peaks are generally within 0 mm to about 25 mm of the upper edge of the base portion and the troughs are generally about 10 mm to about 60 mm below the upper edge of the base portion.

20. A plant package, comprising:

a potted plant comprising a pot and a floral grouping, and a tubular sleeve disposed about the potted plant, the tubular sleeve, comprising:

a base portion having a tapered shape and a lower end and sized to contain the pot;

an upper portion detachable from the base portion via a detaching element; and a decorative pattern or coloring disposed on or inherent to at least a portion of the base portion, with the decorative pattern or coloring having a non-linear upper boundary positioned substantially below the detaching element and wherein the base portion has a clear zone between the detaching element and that portion of the non-linear upper boundary of the decorative pattern or coloring positioned below the detaching element.

21. The plant package of claim 20 wherein the upper portion of the tubular sleeve is sized to substantially surround and enclose the floral grouping disposed within the pot.

22. The plant package of claim 20 wherein the non-linear upper boundary of the decorative pattern or coloring of the tubular sleeve comprises a plurality of peaks and troughs wherein the peaks are generally within 0 mm to about 25 mm of the detaching element and the troughs are generally about 10 mm to about 60 mm below the detaching element.

23. The plant package of claim 20 wherein the lower end of the base portion of the tubular sleeve has a gusset therein.

24. A plant package, comprising:

a potted plant comprising a pot and a floral grouping, and a tubular sleeve disposed about the potted plant, the tubular sleeve comprising:

a base portion having tapered shape, an upper edge, a lower end, and a decorative pattern or coloring disposed on or inherent to at least a portion of the base portion, the decorative pattern or coloring having a non-linear upper boundary positioned below the upper edge of the base portion, and the base portion having a clear zone between the upper edge of the base portion and the non-linear upper boundary of the decorative pattern or coloring.

25. The plant package of claim 24 wherein the non-linear upper boundary of the decorative pattern or coloring of the tubular sleeve comprises a plurality of peaks and troughs wherein the peaks are generally within 0 mm to about 25 mm of the upper edge of the base portion and the troughs are generally about 10 mm to about 60 mm below the upper edge of the base portion.

26. The plant package of claim 24 wherein the lower end of the base portion of the tubular sleeve has a gusset therein.

27. A plant package, comprising:

a potted plant comprising a pot and a floral grouping, and a tubular sleeve disposed about the potted plant, the tubular sleeve, comprising:

a base portion sized to contain the pot and having a gusset in a lower end thereof;

an upper portion detachable from the base portion via a detaching element; and a decorative pattern or coloring disposed on or inherent to at least a portion of the base portion, with the decorative pattern having a non-linear upper boundary positioned substantially below the detaching element, and wherein the base portion has a clear zone between the detaching element and that portion of the non-linear upper boundary of the decorative pattern or coloring positioned below the detaching element.

28. The plant package of claim 27 wherein the upper portion of the tubular sleeve is sized to substantially surround and enclose the floral grouping disposed within the pot.

29. The plant package of claim 27 wherein the non-linear upper boundary of the decorative pattern or coloring of the tubular sleeve comprises a plurality of peaks and troughs wherein the peaks are generally within 0 mm to about 25 mm of the detaching element and the troughs are generally about 10 mm to about 60 mm below the detaching element.

30. A plant package, comprising:

a potted plant comprising a pot and a floral grouping, and a tubular sleeve disposed about the potted plant, the tubular sleeve, comprising:

a base portion sized to contain the pot and having an upper edge, a gusset in a lower end thereof, and a decorative pattern or coloring disposed on or inherent to at least a portion of the base portion, the decorative pattern or coloring having a non-linear upper boundary positioned below the upper edge of the base portion, and the base portion having a clear zone between the upper edge of the base portion and the non-linear upper boundary of the decorative pattern or coloring.

31. The plant package of claim 30 wherein the non-linear upper boundary of the decorative pattern or coloring of the tubular sleeve comprises a plurality of peaks and troughs wherein the peaks are generally within 0 mm to about 25 mm of the upper edge of the base portion and the troughs are generally about 10 mm to about 60 mm below the upper edge of the base portion.

* * * * *